US007467627B2

(12) United States Patent
Matsui et al.

(10) Patent No.: US 7,467,627 B2
(45) Date of Patent: Dec. 23, 2008

(54) IGNITION APPARATUS FOR AN INTERNAL COMBUSTION ENGINE

(75) Inventors: Tomohito Matsui, Hyogo (JP); Takeshi Shimizu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 87 days.

(21) Appl. No.: 11/488,605

(22) Filed: Jul. 19, 2006

(65) Prior Publication Data

US 2007/0181109 A1 Aug. 9, 2007

(30) Foreign Application Priority Data

Feb. 7, 2006 (JP) ..... 2006-029942

(51) Int. Cl.
*H01F 38/12* (2006.01)
*H01F 27/32* (2006.01)
*H01F 27/36* (2006.01)

(52) U.S. Cl. ..... 123/634; 336/84 C

(58) Field of Classification Search ..... 123/633, 123/634, 635; 336/82, 84 C, 90, 96
See application file for complete search history.

(56) References Cited

U.S. PATENT DOCUMENTS

| | | | | | |
|---|---|---|---|---|---|
| 2,882,504 | A * | 4/1959 | Hultgren | 336/96 |
| 5,257,611 | A * | 11/1993 | Chapekis et al. | 123/634 |
| 5,302,931 | A * | 4/1994 | Muz | 336/84 C |
| 5,497,756 | A * | 3/1996 | Matthiesen et al. | 123/634 |
| 6,810,868 | B2 * | 11/2004 | Tsunenaga et al. | 123/634 |
| 7,170,380 | B2 * | 1/2007 | Fischer et al. | 336/90 |
| 2005/0274932 | A1 * | 12/2005 | Knight et al. | 252/500 |

FOREIGN PATENT DOCUMENTS

| | | | |
|---|---|---|---|
| FR | 2799881 | * | 4/2001 |
| JP | 2004-241621 A | | 8/2004 |
| JP | 2005-175470 | * | 6/2005 |

* cited by examiner

*Primary Examiner*—Willis R Wolfe, Jr.
(74) *Attorney, Agent, or Firm*—Sughrue Mion, PLLC

(57) ABSTRACT

An ignition coil apparatus for an internal combustion engine can prevent noise from being radiated to the outside from a transformer without requiring special man-hours even if a case takes a complex shape. The ignition apparatus is provided with a transformer (2) including a primary coil (4), a secondary coil (5) and an iron core 1, a case (3) with the transformer (2) received therein, and an insulating resin 6 filled in the case (3). A high voltage generated at a high voltage side of the secondary coil (5) upon interruption of a primary current supplied to the primary coil (4) is impressed to a spark plug (14). The case (3) is made of a conductive plastic.

5 Claims, 4 Drawing Sheets

IGNITION APPARATUS FOR AN INTERNAL COMBUSTION ENGINE

BACKGROUND OF THE INVENTION

1. Field of the Invention

The present invention relates to an ignition apparatus for an internal combustion engine which impresses a high voltage, for generation of spark discharge, on a spark plug for each engine cylinder.

2. Description of the Related Art

As a conventional ignition apparatus for an internal combustion engine, there has been known one in which a conductive layer is formed on an inner surface of a case made of an insulating plastic that receives therein a transformer comprising a primary coil, a secondary coil and an iron core, and a high voltage, which is generated at a high voltage side of the secondary coil upon interruption of a primary current supplied to the primary coil, is impressed to a spark plug so as to generate a spark discharge in a gap portion between electrodes (see, for example, a first patent document: Japanese patent application laid-open No. 2004-241621).

In this ignition apparatus for an internal combustion engine, noise contained in a discharge current generated by the discharge in the gap portion is radiated into the air from the transformer through the conductive layer formed on the inner surface of the case in the air, whereby electrical devices mounted on a vehicle are prevented from malfunctioning.

In the above-mentioned known ignition apparatus for an internal combustion engine, there is a problem that if the shape of the case is complex, a considerable time and effort is required, when the conductive layer is formed on the inner surface of the case, due to the difficulty in the formation of the conductive layer on the case inner surface.

In addition, the conductive layer is formed by adhering or bonding a thin metal sheet onto the inner surface of the plastic case, and in such a case, there arises another problem that the conductive layer might be cracked by the expansion and contraction operation of the conductive layer due to temperature changes, as a result of which a discharge might be generated in the interior of the cracked conductive layer by a high voltage of the secondary coil, thus generating noise accompanying the discharge.

SUMMARY OF THE INVENTION

Accordingly, the present invention is intended to obviate the problem as referred to above, and has for its object to obtain an ignition apparatus for an internal combustion engine which is capable of preventing noise from being radiated to the outside from a transformer in an easy manner without requiring special man-hours even if a case has a complex shape.

Bearing the above object in mind, according to the present invention, there is provided an ignition coil apparatus for an internal combustion engine which include: a transformer composed of a primary coil, a secondary coil and an iron core; a case with the transformer received therein; and an insulating resin filled into the case. A high voltage generated at a high voltage side of the secondary coil upon interruption of a primary current supplied to the primary coil is impressed to a spark plug. The case is made of a conductive plastic.

According to the ignition coil apparatus for an internal combustion engine of the present invention as constructed above, even if the case takes a complex shape, it is possible to prevent noise from being radiated to the outside from the transformer without requiring special man-hours.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
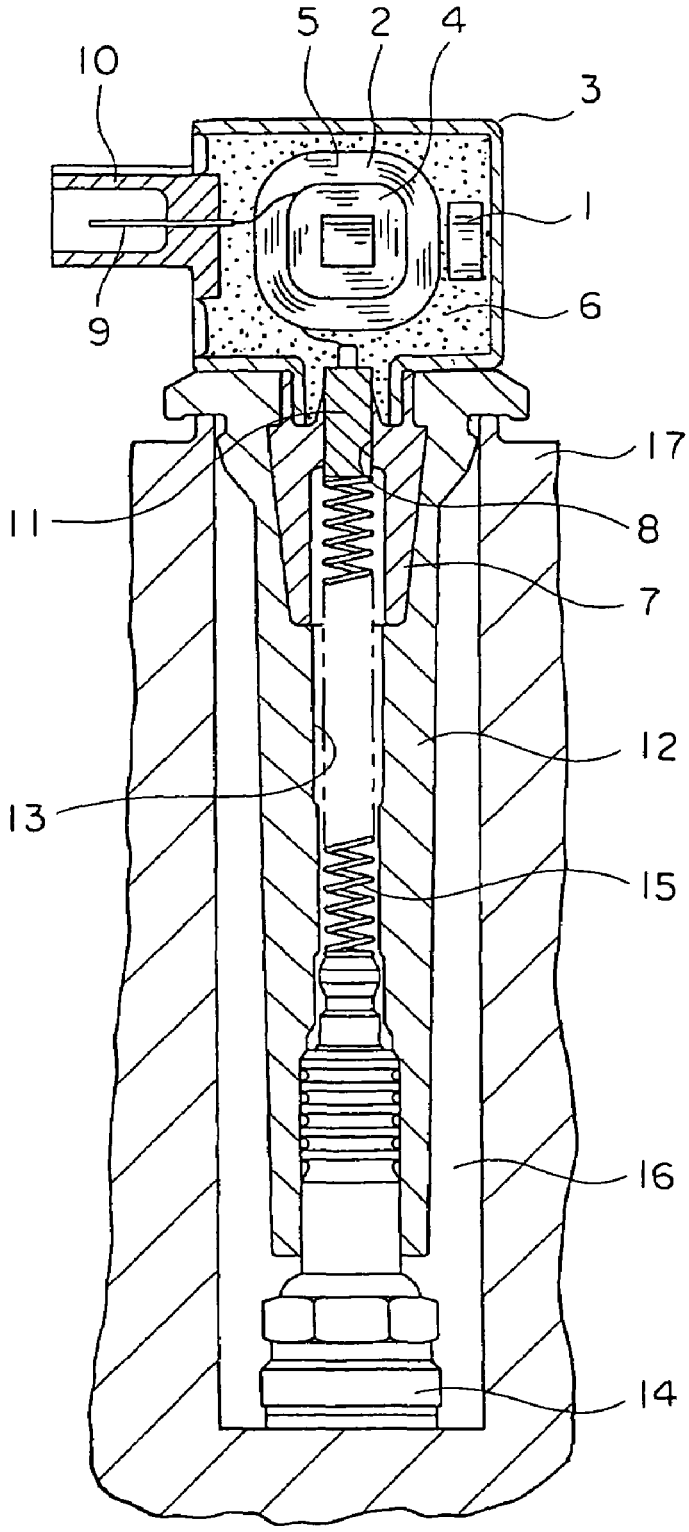
FIG. 1 is a cross sectional view showing an ignition apparatus for an internal combustion engine according to a first embodiment of the present invention.

Now, preferred embodiments of the present invention will be described in detail while referring to the accompanying drawings. Throughout respective figures, the same or corresponding members or parts are identified by the same reference numerals and characters.

Embodiment 1

FIG. 1 is a cross sectional view that shows an ignition apparatus for an internal combustion engine according to a first embodiment of the present invention.

The ignition apparatus for an internal combustion engine illustrated in FIG. 1 is an ignition apparatus of the negative electrode discharge type with a transformer 2 being received in a case 3. The transformer 2 has an iron core 1 that is formed of a plurality of pieces of thin sheet steel, and a primary coil 4 and a secondary coil 5 that are wound around the iron core 1. An insulating resin 6 is filled into the case 3 made of a conductive plastic for insulating and fixedly attaching the transformer 2 to the case 3. Metallic fibers are kneaded into the conductive plastic that forms the case 3. A high voltage tower 7 having an insertion hole 8 formed therein is fitted by insertion into a bottom surface portion of the case 3. At one side surface of the case 3, there is arranged a low voltage connector 10 that has an input terminal 9 connected to the primary coil 4 for supplying thereto an excitation current.

A high voltage output terminal 11 connected to the secondary coil 5 is inserted into the insertion hole 8 of the high voltage tower 7.

A plug boot 12 made of rubber is fitted onto the high voltage tower 7. The plug boot 12 is formed with a through hole 13 along the central axis thereof. A spring 15 electrically connected to a spark plug 14 is disposed in the through hole 13.

Although the high voltage tower 7 and the low voltage connector 10 excluding the input terminal 9 are made of an insulating plastic, they may be made of a conductive plastic if those portions thereof which enclose the input terminal 9 and the high voltage output terminal 11, respectively, are electrically insulated by an insulator.

The ignition apparatus for an internal combustion engine as constructed above is produced according to the following assembly procedure.

First of all, the high voltage tower 7 with the high voltage output terminal 11 being inserted and fitted therein is press-fitted into the case 3.

Then, the transformer 2 electrically connected to the input terminal 9 of the low voltage connector 10 is arranged in the case 3 while being connected with the high voltage output terminal 11.

Thereafter, the insulating resin 6 is injected into the case 3 from the low voltage connector 10 side to be set therein, whereby the low voltage connector 10, the high voltage output terminal 11 and the transformer 2 are electrically insulated from one another and are fixedly attached to the casing 3. Here, note that the high voltage tower 7 is press-fitted into and fixedly secured to an engagement portion of the case 3, and hence the insulating resin 6 does not flow out of the case 3 when being injected into the case 3, but a sealing material may be coated on the engagement portion as required.

Finally, the assembly of the ignition apparatus for an internal combustion engine is completed by assembling the plug boot 12 with the spring 15 inserted into the through hole 13 therein to the high voltage tower 7.

The ignition apparatus for an internal combustion engine thus produced is fixedly attached to a cam cover 17 with the plug boot 12 being inserted into a plug hole 16 in the cam cover 17. At this time, the spring 15 presses, at its one or tip end, one end face of the spark plug 14.

In the ignition apparatus for an internal combustion engine as constructed above, a high negative voltage is impressed to the high voltage output terminal 11, and a discharge current containing noise discharged in the gap portion of the spark plug 14 flows toward the transformer 2 through the spring 15 and the high voltage output terminal 11. At this time, the transformer 2 is enclosed with the case 3 made of the conductive plastic, so the noise contained in the discharge current is prevented from radiating from the case 3 into the air.

In addition, the case 3, being made of the conductive plastic, is able to prevent the radiation of the noise from the transformer to the outside even with the complex shape of the case 3 without the need for special man-hours.

Moreover, there is no inconvenience which would occur in conventional ignition apparatuses, such as the generation of noise according to a fresh discharge due to a crack generated in the conductive layer that is formed by bonding a metal sheet on the inner surface of the case 3.

Further, the metal fiber is kneaded into the conductive plastic, so the physical strength of the case 3 is increased, and the strength of the insulating resin 6 against the thermal expansion and contraction is also increased.

Embodiment 2

Figure 2:
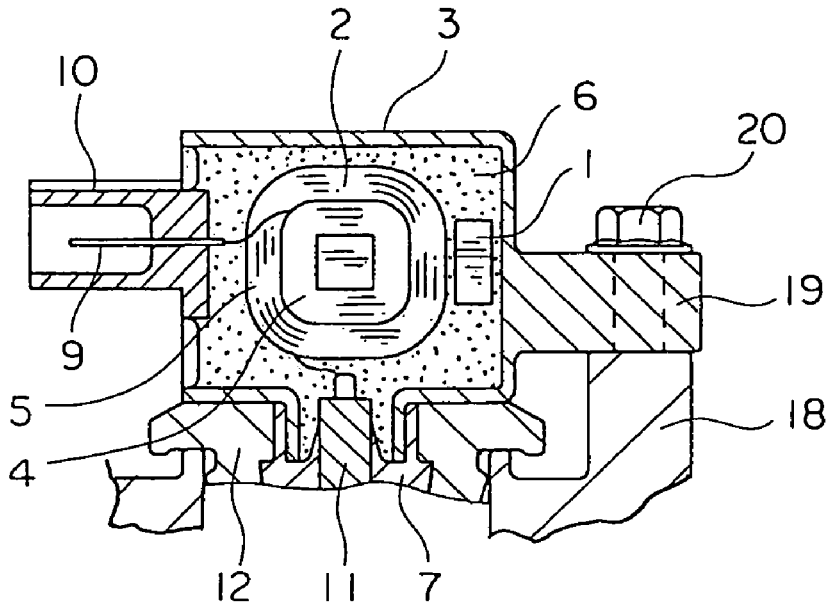
FIG. 2 is a cross sectional view showing essential portions of an ignition apparatus for an internal combustion engine according to a second embodiment of the present invention.

FIG. 2 is a cross sectional view that shows essential portions of an ignition apparatus for an internal combustion engine according to a second embodiment of the present invention.

In this embodiment, a case 3 made of a conductive plastic has a flange portion 19 which is to be mounted on an engine 18.

The construction of this second embodiment other than the above is similar to that of the first embodiment.

In this second embodiment, the operational effects substantially similar to those of the first embodiment can be obtained, and by fixedly attaching the ignition apparatus to the engine 18 by the use of bolts 20, a discharge current can be escaped to ground (GND) without needing any special work for connection to GND.

In addition, the static electricity on the case 3 electrified by a high voltage generated by a transformer 2 can be escaped to GND through the flange portion 19, too, whereby the generation of noise due to discharge between the transformer 2 and the case 3 can be prevented.

Embodiment 3

Figure 3:
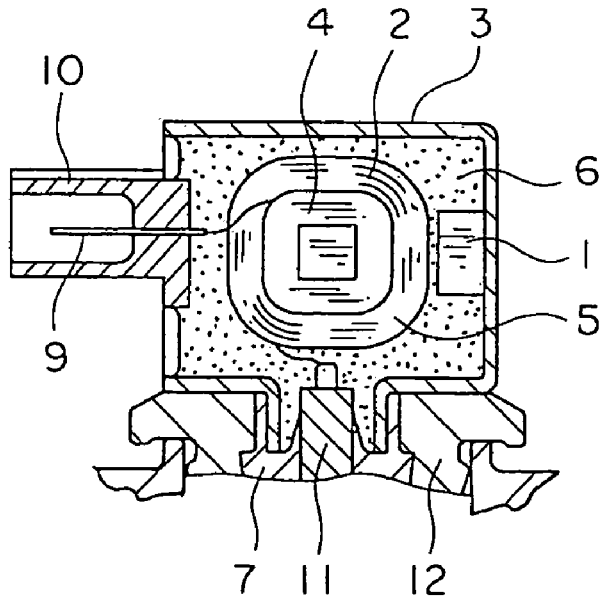
FIG. 3 is a cross sectional view showing an ignition apparatus for an internal combustion engine according to a third embodiment of the present invention.

FIG. 3 is a cross sectional view that shows essential portions of an ignition apparatus for an internal combustion engine according to a third embodiment of the present invention.

In this embodiment,. an iron core 1 of a transformer 2 is in surface contact with an inner wall surface of a case 3.

The construction of this third embodiment other than the above is similar to that of the first embodiment.

In this third embodiment, the operational effects substantially similar to those of the first embodiment can be obtained, and it is possible to prevent the occurrence of noise due to a discharge generated between the iron core 1 and the case 3 by the voltage induced in the iron core 1 upon generation of an output voltage.

Embodiment 4

Figure 4:
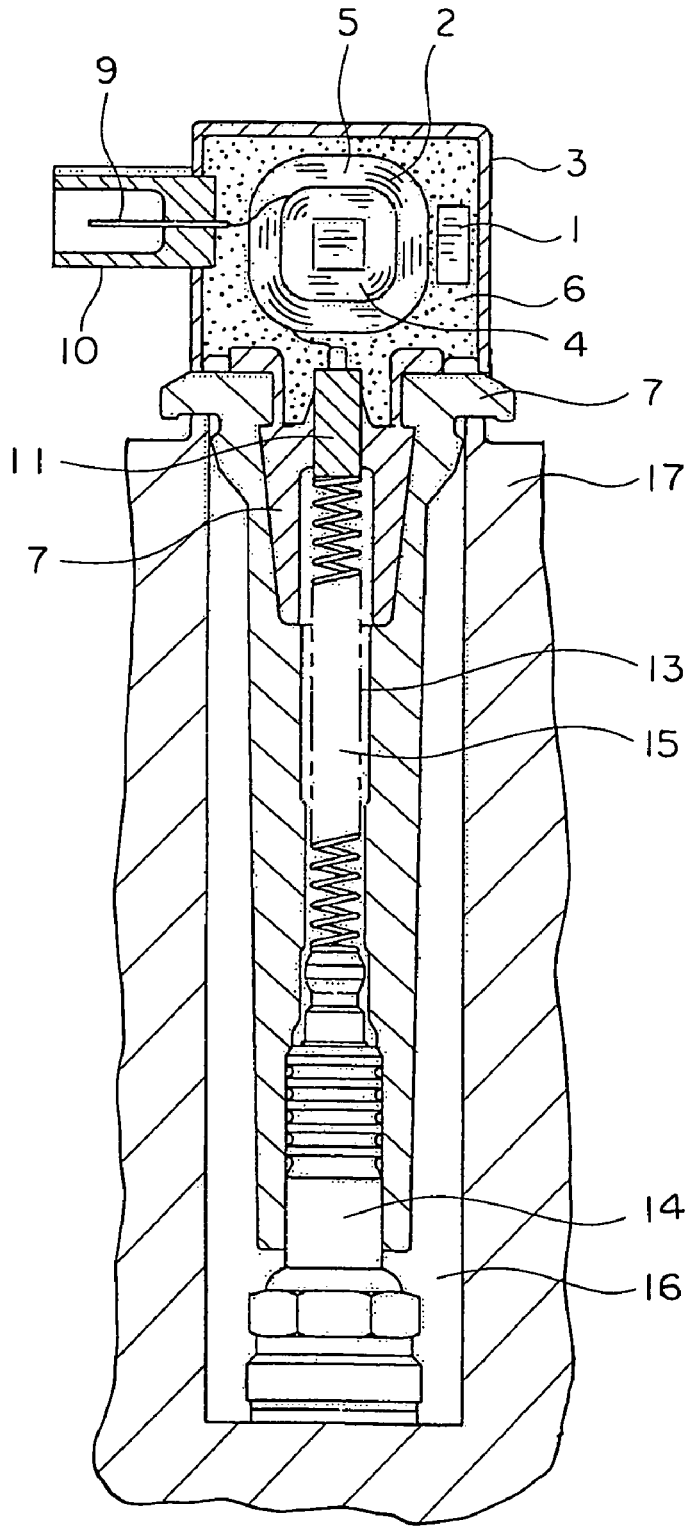
FIG. 4 is a cross sectional view showing an ignition apparatus for an internal combustion engine according to a fourth embodiment of the present invention.

FIG. 4 is a cross sectional view showing an ignition apparatus for an internal combustion engine according to a fourth embodiment of the present invention.

In this embodiment, a case 3 has an opening portion, from which an insulating resin 6 is filled therein, arranged in opposition to a spark plug 14. That is, five among six surfaces that enclose the periphery of a transformer 2 are covered with a conductive plastic, and the opening portion of the case 3 necessary for assembly of parts is arranged in opposition to the spark plug 14.

In the ignition apparatus for an internal combustion engine as constructed above, the opening portion of the case 3 with a low voltage connector 10 mounted to a side surface thereof is arranged in an upward direction, and under such a condition, the transformer 2 is arranged in the case 3 while being connected to an input terminal 9 of the low voltage connector 10 and a high voltage output terminal 11 inserted into a high voltage tower 7.

Thereafter, with the high voltage tower 7 being temporally attached to the opening portion of the case 3 by means of a jig for example, an insulating resin 6 is injected into the case 3 from its opening portion and set therein to fixedly secure the transformer 2 and the high voltage tower 7 to the case 3.

Finally, the assembly of the ignition apparatus for an internal combustion engine is completed by assembling a plug boot 12 with a spring 15 inserted into a through hole 13 therein to the high voltage tower 7.

In this fourth embodiment, the opening portion of the case 3 with the insulating resin 6 being filled therein is arranged in opposition to the spark plug 14, so the release of noise radiated from the transformer 2 to the outside is shielded in all directions, and the radiation of noise from the case 3 into the air can be suppressed in a more effective manner, as compared with the first embodiment.

Embodiment 5

Figure 5:
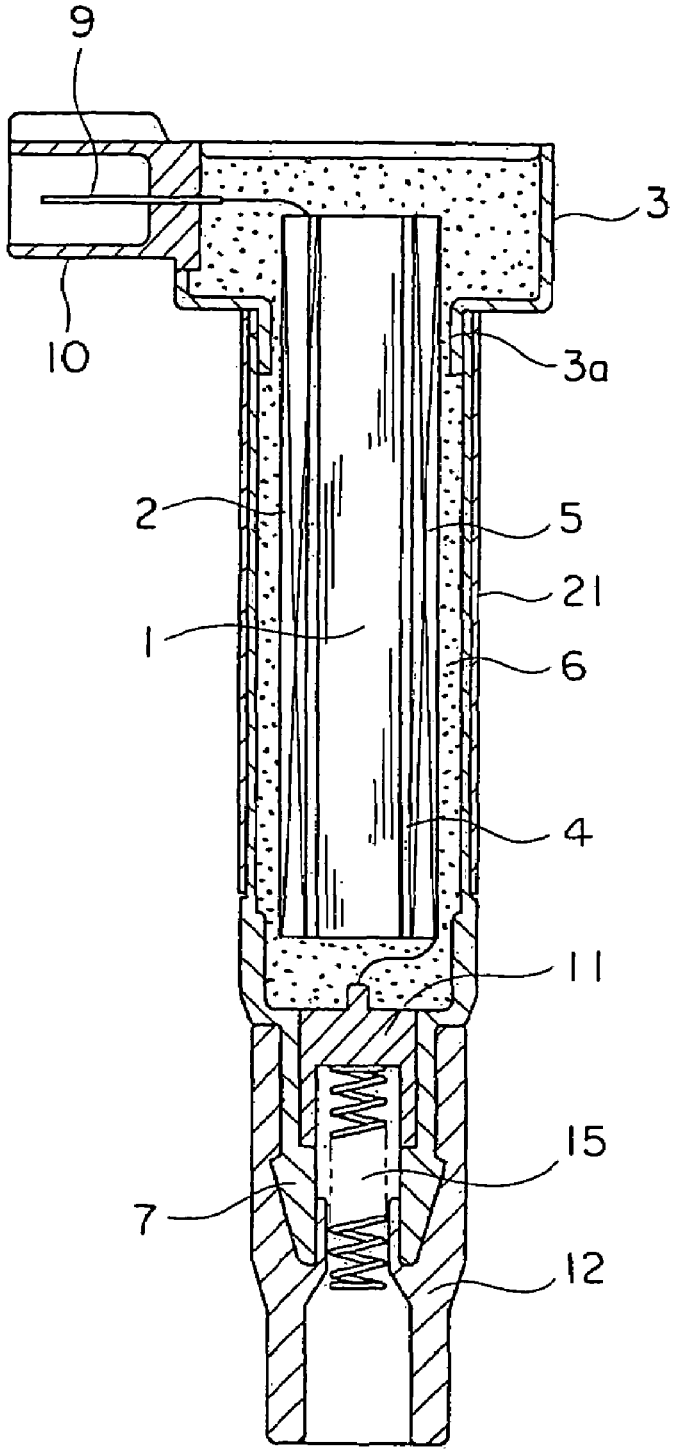
FIG. 5 is a cross sectional view showing an ignition apparatus for an internal combustion engine according to a fifth embodiment of the present invention.

FIG. 5 is a cross sectional view that shows an ignition apparatus for an internal combustion engine according to a fifth embodiment of the present invention.

In this embodiment, a transformer 2 is composed of an iron core 1 formed of pieces of laminated thin sheet plates, a primary winding 4 surrounding the iron core 1, and a secondary winding 5 surrounding the primary winding 4. The transformer 2 has an upper end portion protruded from a bottom surface of a case 3 made of a conductive plastic. The case 3 has a protrusion 3*a* protruded from the bottom surface thereof, over which an upper end portion of a cylindrical high voltage tower 7 is fitted. At an upper portion of the high voltage tower 7, there is arranged an external core 21, which serves as a path for the magnetic flux generated when a primary current is supplied to the primary coil 4, so as to enclose the high voltage tower 7. The external core 21 has an upper end portion that encloses the protrusion 3*a* of the case 3.

A high voltage output terminal 11 is inserted and fitted into an inner side of a lower portion of the high voltage tower 7. A spring 15 is arranged in the interior of the high voltage output terminal 11, and a plug boot 12 is fitted onto an outer side of the lower portion of the high voltage tower 7. The transformer 2 is fixedly secured to the case 3 and the high voltage tower 7 by means of an insulating resin 6 that is filled into the interiors of the case 3 and the high voltage tower 7.

The construction of this fifth embodiment other than the above is similar to that of the first embodiment.

In this fifth embodiment, the transformer 2 is enclosed with the case 3 made of the conductive plastic and the external core 21, so that noise released from the transformer 2 to the outside can be shielded by the case 3 and the external core 21.

In addition, the expensive conductive plastic need only be used for the case 3 alone, and hence it is possible to suppress high cost.

While the invention has been described in terms of preferred embodiments, those skilled in the art will recognize that the invention can be practiced with modifications within the spirit and scope of the appended claims.

What is claimed is:

1. An ignition apparatus for an internal combustion engine, comprising:

a transformer composed of a primary coil, a secondary coil and an iron core;

a case with said transformer received therein; and an insulating resin filled into said case;

wherein a high voltage generated at a high voltage side of said secondary coil upon interruption of a primary current supplied to said primary coil is impressed on a spark plug; and said case is made of a conductive plastic, wherein said case has a flange portion that is to be mounted on an engine.

2. An ignition apparatus for an internal combustion engine, comprising:

a transformer composed of a primary coil, a secondary coil and an iron core;

a case with said transformer received therein; and an insulating resin filled into said case;

wherein a high voltage generated at a high voltage side of said secondary coil upon interruption of a primary current supplied to said primary coil is impressed on a spark plug; and said case is made of a conductive plastic, wherein said transformer is in surface contact with an inner wall surface of said case.

3. An ignition apparatus for an internal combustion engine, comprising:

a transformer composed of a primary coil, a secondary coil and an iron core;

a case with said transformer received therein; and an insulating resin filled into said case;

wherein a high voltage generated at a high voltage side of said secondary coil upon interruption of a primary current supplied to said primary coil is impressed on a spark plug; and said case is made of a conductive plastic, wherein said case has an opening portion, from which said insulating resin is filled into said case, arranged in opposition to said spark plug.

4. An ignition apparatus for an internal combustion engine comprising:

a transformer composed of a primary coil, a secondary coil and an iron core;

an exterior iron core that is arranged so as to enclose said transformer and form a path for a magnetic flux generated when a primary current is supplied to said primary winding; and a case that encloses an end of said transformer protruded from said external iron core and is connected to a low voltage connector for supplying an excitation current to said primary coil;

wherein a high voltage generated at a high voltage side of said secondary coil upon interruption of a primary current supplied to said primary coil is impressed on a spark plug; and said case is made of a conductive plastic.

5. The ignition apparatus for an internal combustion engine as set forth in claim 4, wherein said conductive plastic includes a metal fiber mixed therein.

* * * * *